US007794515B2

(12) United States Patent
Oh et al.

(10) Patent No.: US 7,794,515 B2
(45) Date of Patent: Sep. 14, 2010

(54) CYCLONE SEPARATING APPARATUS FOR VACUUM CLEANER

(75) Inventors: Jang-keun Oh, Gwangju (KR); Seung-yong Cha, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 549 days.

(21) Appl. No.: 11/826,284

(22) Filed: Jul. 13, 2007

(65) Prior Publication Data

US 2008/0190080 A1 Aug. 14, 2008

(30) Foreign Application Priority Data

Feb. 14, 2007 (KR) ..... 10-2007-0015478

(51) Int. Cl.
*B01D 45/00* (2006.01)

(52) U.S. Cl. ..... 55/343; 55/337; 55/345; 55/DIG. 3; 15/352; 15/353; 96/414; 96/416

(58) Field of Classification Search ..... 55/337, 55/345, 343, DIG. 3; 15/353; 96/414, 416
See application file for complete search history.

(56) References Cited

U.S. PATENT DOCUMENTS

| | | | | |
|---|---|---|---|---|
| 1,207,034 | A | | 12/1916 | Harsant |
| 1,416,885 | A | | 5/1922 | Schreiner |
| 1,416,995 | A | | 5/1922 | Stroud |
| 2,539,257 | A | | 1/1950 | Limberg |
| 2,511,387 | A | | 6/1950 | Watson et al. |
| 2,539,195 | A | | 1/1951 | Lang |
| 2,553,175 | A | | 5/1951 | Davenport et al. |
| 3,046,718 | A | | 7/1962 | Ide et al. |
| 3,078,650 | A | | 2/1963 | Anderson |
| 3,425,192 | A | | 2/1969 | Davis |
| 3,769,781 | A | | 11/1973 | Klein et al. |
| 3,898,068 | A | | 8/1975 | McNell |
| 4,373,228 | A | | 2/1983 | Dyson |
| 4,409,008 | A | * | 10/1983 | Solymes ..... 96/372 |
| 4,826,515 | A | | 5/1989 | Dyson |
| 4,853,008 | A | | 8/1989 | Dyson et al. |
| 5,078,761 | A | | 1/1992 | Dyson |
| 5,145,499 | A | | 9/1992 | Dyson et al. |
| 5,160,356 | A | | 11/1992 | Dyson |
| 5,163,786 | A | | 11/1992 | Christianson |
| 5,254,147 | A | | 10/1993 | Finke |
| 5,307,538 | A | | 5/1994 | Rench et al. |

(Continued)

FOREIGN PATENT DOCUMENTS

| | | |
|---|---|---|
| CN | 87205753 | 10/1987 |
| CN | 2087999 | 11/1991 |
| CN | 1067295 | 12/1992 |
| CN | 22550815 Y | 2/1997 |
| CN | 1296801 A | 5/2000 |

(Continued)

*Primary Examiner*—Jason M Greene
*Assistant Examiner*—Dung Bui
(74) *Attorney, Agent, or Firm*—Blank Rome LLP

(57) ABSTRACT

A cyclone separating apparatus for a vacuum cleaner includes a first cyclone with an air entrance disposed on a lower portion of the first cyclone and an air exit disposed at an upper portion of the first cyclone; a first contaminants chamber substantially enclosing the first cyclone to collect contaminants discharged from the first cyclone; a plurality of second cyclones above the first cyclone, the plurality of second cyclones being substantially perpendicular to a center axis of the first cyclone; and a second contaminants chamber disposed outside the first contaminants chamber to collect contaminants discharged from the plurality of second cyclones.

15 Claims, 7 Drawing Sheets

U.S. PATENT DOCUMENTS

| | | | | |
|---|---|---|---|---|
| 6,171,356 | B1 | 1/2001 | Twerdun et al. | |
| 6,238,451 | B1 | 5/2001 | Conrad et al. | |
| 6,264,712 | B1 | 7/2001 | Decker | |
| 6,269,518 | B1 | 8/2001 | Yung | |
| 6,334,234 | B1 | 1/2002 | Conrad et al. | |
| 6,350,292 | B1 * | 2/2002 | Lee et al. | 55/459.1 |
| 6,368,373 | B1 | 4/2002 | Mueller | |
| 6,428,589 | B1 | 8/2002 | Bair et al. | |
| 6,431,404 | B1 | 8/2002 | Long, Jr. | |
| 6,436,160 | B1 | 8/2002 | Stephens et al. | |
| 6,582,489 | B2 | 6/2003 | Conrad | |
| 6,607,572 | B2 | 8/2003 | Gammack et al. | |
| 6,625,845 | B2 | 9/2003 | Matsumoto et al. | |
| 6,679,930 | B1 * | 1/2004 | An et al. | 55/337 |
| 6,740,144 | B2 | 5/2004 | Conrad et al. | |
| 6,746,500 | B1 | 6/2004 | Park et al. | |
| 6,766,558 | B1 | 7/2004 | Matsumoto et al. | |
| 6,829,804 | B2 | 12/2004 | Sepke | |
| 6,840,972 | B1 * | 1/2005 | Kim | 55/337 |
| 7,097,680 | B2 | 8/2006 | Oh | |
| 7,140,068 | B1 | 11/2006 | Vander Baan et al. | |
| 7,169,201 | B2 | 1/2007 | Oh et al. | |
| 7,326,268 | B2 * | 2/2008 | Oh et al. | 55/343 |
| 2001/0005983 | A1 | 7/2001 | Berfield et al. | |
| 2001/0005986 | A1 | 7/2001 | Matsubara et al. | |
| 2001/0025395 | A1 | 10/2001 | Matsumoto et al. | |
| 2001/0054213 | A1 | 12/2001 | Oh et al. | |
| 2002/0011053 | A1 | 1/2002 | Oh | |
| 2002/0020154 | A1 | 2/2002 | Yang | |
| 2002/0066366 | A1 | 6/2002 | Conrad et al. | |
| 2003/0067765 | A1 | 4/2003 | Li | |
| 2004/0010885 | A1 | 1/2004 | Hitzelberger et al. | |
| 2004/0025285 | A1 | 2/2004 | McCormick et al. | |
| 2004/0074041 | A1 | 4/2004 | Overvaag | |
| 2004/0098958 | A1 | 5/2004 | Roth et al. | |
| 2004/0103785 | A1 | 6/2004 | North | |
| 2005/0050678 | A1 | 3/2005 | Oh et al. | |
| 2005/0252179 | A1 * | 11/2005 | Oh et al. | 55/337 |
| 2005/0252180 | A1 | 11/2005 | Oh et al. | |
| 2006/0042039 | A1 | 3/2006 | McDowell et al. | |
| 2006/0123590 | A1 | 6/2006 | Fester et al. | |
| 2006/0156699 | A1 * | 7/2006 | Kim | 55/345 |
| 2006/0168923 | A1 * | 8/2006 | Lee et al. | 55/345 |
| 2006/0230726 | A1 * | 10/2006 | Oh et al. | 55/345 |
| 2007/0011998 | A1 * | 1/2007 | Yoo et al. | 55/337 |
| 2007/0079580 | A1 * | 4/2007 | Oh | 55/345 |
| 2007/0079587 | A1 * | 4/2007 | Kim | 55/349 |
| 2007/0084160 | A1 * | 4/2007 | Kim | 55/345 |
| 2007/0084161 | A1 * | 4/2007 | Yoo | 55/345 |
| 2007/0144116 | A1 * | 6/2007 | Hong et al. | 55/345 |
| 2007/0175185 | A1 * | 8/2007 | Kim et al. | 55/337 |
| 2007/0214754 | A1 * | 9/2007 | Kim | 55/345 |
| 2007/0289266 | A1 * | 12/2007 | Oh | 55/337 |
| 2008/0184893 | A1 * | 8/2008 | Oh et al. | 96/416 |
| 2008/0223010 | A1 * | 9/2008 | Han et al. | 55/345 |
| 2008/0256911 | A1 * | 10/2008 | Oh et al. | 55/346 |
| 2009/0056290 | A1 * | 3/2009 | Oh et al. | 55/337 |
| 2009/0178376 | A1 * | 7/2009 | Ha et al. | 55/322 |
| 2009/0193771 | A1 * | 8/2009 | Oh et al. | 55/337 |
| 2009/0205162 | A1 * | 8/2009 | Oh et al. | 15/353 |

FOREIGN PATENT DOCUMENTS

| | | | |
|---|---|---|---|
| CN | 1361673 | | 7/2000 |
| CN | 2518598 | | 10/2002 |
| CN | 1389175 | | 1/2003 |
| CN | 2530580 | | 1/2003 |
| CN | 1422187 | | 6/2003 |
| CN | 1426745 | | 7/2003 |
| CN | 1434688 | | 8/2003 |
| CN | 1836621 | | 9/2006 |
| DE | 1282872 | | 11/1968 |
| DE | 2811536 | | 11/1978 |
| DE | 1336829 | | 11/1979 |
| DE | 29908567 | U1 | 1/2000 |
| DE | 20102723 | | 6/2001 |
| DE | 10132690 | | 7/2002 |
| DE | 20306405 | | 10/2003 |
| DE | 10110581 | C2 | 11/2003 |
| DE | 102004028677 | | 3/2005 |
| DE | 102004028675 | | 4/2005 |
| DE | 102004028676 | | 4/2005 |
| DE | 102004030600 | | 9/2005 |
| EP | 0095354 | | 11/1983 |
| EP | 0923992 | A2 | 6/1999 |
| EP | 1199023 | A1 | 4/2002 |
| EP | 1362543 | | 11/2003 |
| EP | 1707273 | | 10/2006 |
| ES | 2105467 | | 10/1997 |
| ES | 2196837 | | 12/2003 |
| FR | 2619498 | | 2/1989 |
| FR | 2859370 | | 3/2005 |
| FR | 2878144 | | 5/2006 |
| GB | 835884 | | 5/1960 |
| GB | 1107045 | | 3/1968 |
| GB | 1207034 | | 9/1970 |
| GB | 2317122 | | 3/1998 |
| GB | 2326360 | | 12/1998 |
| GB | 2360719 | | 10/2001 |
| GB | 2374305 | | 10/2002 |
| GB | 2375980 | | 12/2002 |
| GB | 2376176 | | 12/2002 |
| GB | 2377656 | | 1/2003 |
| GB | 2381484 | | 5/2003 |
| GB | 2406065 | | 3/2005 |
| GB | 2426726 | | 12/2006 |
| JP | 50101012 | | 8/1975 |
| JP | S5214775 | | 2/1977 |
| JP | SHO 53-141859 | | 11/1978 |
| JP | 09-234174 | | 9/1997 |
| JP | 09234174 | | 9/1997 |
| JP | 2002051951 | | 2/2002 |
| JP | 2002143052 | | 5/2002 |
| JP | 2002172077 | | 6/2002 |
| JP | 2002326041 | | 11/2002 |
| JP | 2003024826 | | 1/2003 |
| JP | 2003116752 | | 4/2003 |
| JP | 2004357767 | A | 12/2004 |
| KR | 1019930000527 | B1 | 1/1993 |
| KR | 19930021001 | | 10/1993 |
| KR | 1020030032497 | A | 4/2003 |
| KR | 1020040017195 | A | 2/2004 |
| KR | 1020040099980 | | 12/2004 |
| KR | 100667877 | | 1/2007 |
| KR | 1020070000633 | | 1/2007 |
| RU | 2137530 | | 9/1999 |
| RU | 2174452 | | 10/2001 |
| RU | 2206029 | | 6/2003 |
| RU | 2286079 | | 7/2006 |
| WO | WO-99/42198 | | 8/1999 |
| WO | WO-0044272 | | 8/2000 |
| WO | WO-00/64321 | | 11/2000 |
| WO | WO-00/74547 | | 12/2000 |
| WO | WO-00/74548 | | 12/2000 |
| WO | WO-01/60524 | A1 | 8/2001 |
| WO | WO-0174493 | | 10/2001 |
| WO | WO-0195780 | | 12/2001 |
| WO | WO-02067750 | | 9/2002 |
| WO | WO 02067756 | | 9/2002 |
| WO | WO-0330702 | | 4/2003 |

* cited by examiner

CYCLONE SEPARATING APPARATUS FOR VACUUM CLEANER

CROSS-REFERENCES TO RELATED APPLICATIONS

This application claims the benefit under 35 U.S.C. §119 (a) from Korean Patent Application No. 2007-15478 filed Feb. 14, 2007 in the Korean Intellectual Property Office, the disclosure of which is incorporated herein by reference in its entirety.

This application may be related to the copending U.S. patent application Ser. No. 10/840,248, filed May 7, 2004 entitled "Cyclone Separating Apparatus and a Vacuum Cleaner Having the Same" by Jang-Keun Oh et al., the entire disclosure of which is incorporated herein by reference.

This application may be related to the copending U.S. patent application Ser. No. 10/840,230, filed May 7, 2004 entitled "Cyclone Separating Apparatus and a Vacuum Cleaner Having the Same" by Jang-Keun Oh et al., the entire disclosure of which is incorporated herein by reference.

This application may be related to the copending U.S. patent application Ser. No. 10/840,231, filed May 7, 2004 entitled "Cyclone Dust Separating Apparatus and Vacuum Cleaner Having the Same" by Jang-Keun Oh et al., the entire disclosure of which is incorporated herein by reference.

This application may be related to the copending U.S. patent application Ser. No. 10/851,114, filed May 24, 2004 entitled "Cyclone Dust Collecting Device for Vacuum Cleaner" by Jang-Keun Oh et al., the entire disclosure of which is incorporated herein by reference.

This application may be related to the copending U.S. patent application Ser. No. 10/874,257, filed Jun. 24, 2004 entitled "Cyclone Dust Collecting Apparatus for a Vacuum Cleaner" by Jang-Keun Oh et al., the entire disclosure of which is incorporated herein by reference.

This application may be related to the copending U.S. patent application Ser. No. 11/137,506, filed May 26, 2005 entitled "Vacuum Cleaner Dust Collecting Apparatus" by Jung-Gyun Han et al., the entire disclosure of which is incorporated herein by reference.

This application may be related to the copending U.S. patent application Ser. No. 11/206,878, filed Aug. 19, 2005 entitled "Dust Collecting Apparatus of a Vacuum Cleaner" by Ji-Won Seo et al., the entire disclosure of which is incorporated herein by reference.

This application may be related to the copending U.S. patent application Ser. No. 11/203,990, filed Aug. 16, 2005 entitled "Dust-Collecting Apparatus and Method for a Vacuum Cleaner" by Ji-Won Seo et al., the entire disclosure of which is incorporated herein by reference.

This application may be related to the copending U.S. patent application Ser. No. 11/281,732, filed Nov. 18, 2005 entitled "Dust Collecting Apparatus for a Vacuum Cleaner" by Jung-Gyun Han et al., the entire disclosure of which is incorporated herein by reference.

This application may be related to the copending U.S. patent application Ser. No. 11/315,335, filed Dec. 23, 2005 entitled "Multi-Cyclone Dust Separating Apparatus" by Dong-Yun Lee et al., the entire disclosure of which is incorporated herein by reference.

This application may be related to the U.S. Pat. No. 7,097,680, granted Aug. 29, 2006 entitled "Cyclone Separating Apparatus and Vacuum Cleaner Equipped with the Same" by Jang-Keun Oh, the entire disclosure of which is incorporated herein by reference.

FIELD OF THE INVENTION

The present invention relates to a vacuum cleaner. More particularly, the present invention relates to a cyclone separating apparatus for a vacuum cleaner.

BACKGROUND OF THE INVENTION

Generally, vacuum cleaners generate a suction force to draw-in dust or other contaminants through a suction nozzle. A contaminants collecting apparatus is disposed in a main body of the vacuum cleaner. It separates contaminants from air and collects the contaminants. The term "contaminants" will be used herein to refer collectively to dust, dirt particulates, debris, and other similar matter than can be entrained with the air drawn in by the vacuum cleaner. The air is then discharged outside the main body of the vacuum cleaner.

Conventional contaminant collecting apparatuses use a cyclone separating apparatus to separate contaminants from air by centrifugal force that separates contaminants from air and removes relatively large contaminants from air. However, such conventional apparatuses cannot effectively remove fine contaminants from air.

To remove fine contaminants more effectively, a multi-cyclone separating apparatus has been developed. However, in the conventional multi-cyclone separating apparatus for a vacuum cleaner, air enters and is discharged through an upper portion of the first cyclone. Because the air whirls downward and then whirls upward to exit, the complex air path prevents high contaminant separating efficiency. Also, the contaminants separated from the first cyclone are often collected in a space that is in fluid communication with whirling air. Thus, the collected contaminants impede the whirling of the air and therefore reduce the centrifugal force developed which reduces contaminant separating efficiency.

SUMMARY OF THE INVENTION

The present invention has been developed in order to overcome the above drawbacks and other problems associated with the conventional arrangement. An aspect of the present invention is to provide a cyclone separating apparatus for a vacuum cleaner that has a high contaminant separating efficiency.

One embodiment of the present invention provides a cyclone separating apparatus for a vacuum cleaner. The cyclone separating apparatus includes a first cyclone with an air entrance disposed on a lower portion of the first cyclone and an air exit disposed at an upper portion of the first cyclone; a first contaminants chamber substantially enclosing the first cyclone to collect contaminants discharged from the first cyclone; a plurality of second cyclones located above the first cyclone, the plurality of second cyclones being substantially perpendicular to a center axis of the first cyclone; and a second contaminants chamber disposed outside the first contaminants chamber to collect contaminants discharged from the plurality of second cyclones.

Another embodiment of the present invention provides a cyclone separating apparatus for a vacuum cleaner. The cyclone separating apparatus includes a first cyclone with an air entrance disposed on a lower portion of the first cyclone and an air exit disposed at an upper portion of the first cyclone; a first contaminants chamber substantially enclosing the first cyclone to collect contaminants discharged from the first cyclone; a plurality of second cyclones disposed to be inclined upwardly with respect to a top plane of the first cyclone; and a second contaminants chamber disposed outside the first contaminants chamber to collect contaminants discharged from the plurality of second cyclones.

Yet another embodiment of the present invention provides a cyclone separating apparatus for a vacuum cleaner. The cyclone separating apparatus includes a first cyclone unit and a second cyclone unit. The first cyclone unit has a first cyclone with an air entrance disposed on a lower portion of the first cyclone and an air exit disposed at an upper portion of the first cyclone, a first contaminants chamber substantially enclosing the first cyclone to collect contaminants discharged from the first cyclone, and a second contaminants chamber disposed outside the first contaminants chamber. The second cyclone unit has a plurality of second cyclones disposed above the first cyclone unit and substantially perpendicular to a center axis of the first cyclone, a discharging air gathering member in fluid communication with the plurality of second cyclones, and a housing substantially enclosing the plurality of second cyclones.

Other objects, advantages and salient features of the invention will become apparent from the following detailed description, which, taken in conjunction with the annexed drawings, discloses preferred embodiments of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE INVENTION

Hereinafter, certain exemplary embodiments of the present invention will be described in detail with reference to the accompanying drawings.

The matters defined in the description, such as a detailed construction and elements thereof, are provided to assist in a comprehensive understanding of the invention. Thus, it is apparent that the present invention may be carried out without those defined matters. Also, well-known functions or constructions are omitted to provide a clear and concise description of exemplary embodiments of the present invention.

Figure 1:
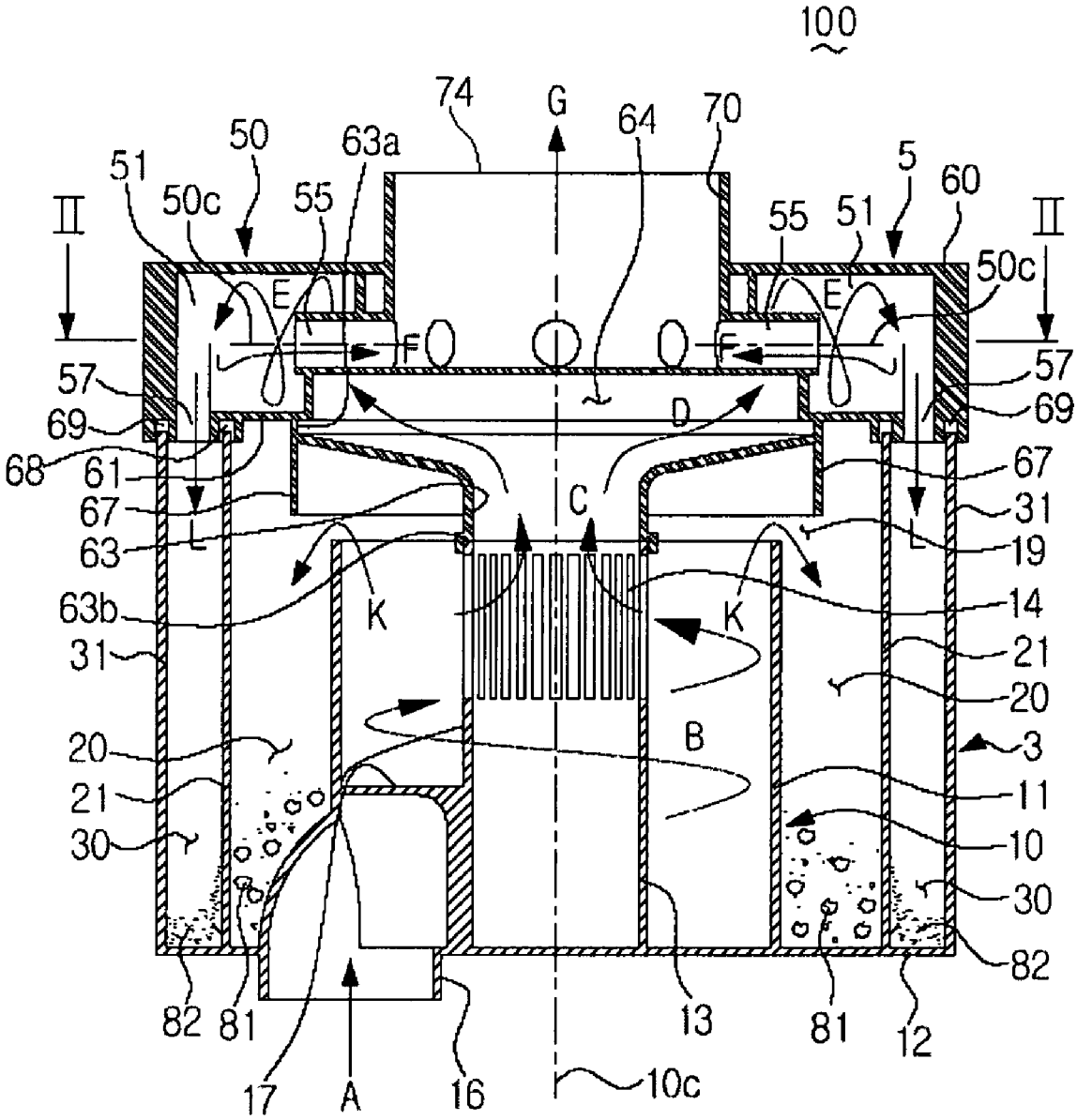
FIG. 1 is a sectional elevational view illustrating a cyclone separating apparatus for a vacuum cleaner according to a first embodiment of the present invention.

Referring to FIG. 1, a cyclone separating apparatus 100 for a vacuum cleaner according to a first embodiment of the present invention may include a first cyclone unit 3 and a second cyclone unit 5.

The first cyclone unit 3 may be provided with a first cyclone 10, a first contaminants chamber 20, and a second contaminants chamber 30. The first cyclone 10 separates relatively large contaminants from drawn-in air. Air enters a lower portion of the first cyclone 10, and after contaminants are separated from the air, air may then be discharged through an upper portion of the first cyclone 10. Relatively large contaminants separated from air move in a direction against gravity.

The first cyclone 10 may be formed in a substantially hollow cylindrical shape with an inner wall 11. The inner wall 11 may have an open top and a bottom closed by a bottom plate 12. A first air entering pipe 16 may be disposed in the bottom plate 12. The first air entering pipe 16 may form a first air entrance. The first air entering part 16 may also be in fluid communication with a suction nozzle (not illustrated) of the vacuum cleaner.

A first air discharging pipe 13 may be disposed inside the first cyclone 10. The first air discharging pipe 13 may be formed as a substantially circular pipe. On an upper part of the first air discharging pipe 13 may be formed a plurality of slots 14. The plurality of slots 14 may form a first air exit through which air from the first cyclone 10 may be discharged.

A helical-shaped sloping surface 17 may be disposed on the bottom plate 12 between the inner wall 11 and the first air discharging pipe 13. Therefore, air entering through the first air entering pipe 16 may rise up while whirling before being discharged through the plurality of slots 14. Contaminants separated from the air may rise up along the inner wall 11 and then over the top end of the inner wall 11 to be discharged to the first contaminants chamber 20, as shown by arrow K.

Figure 2:
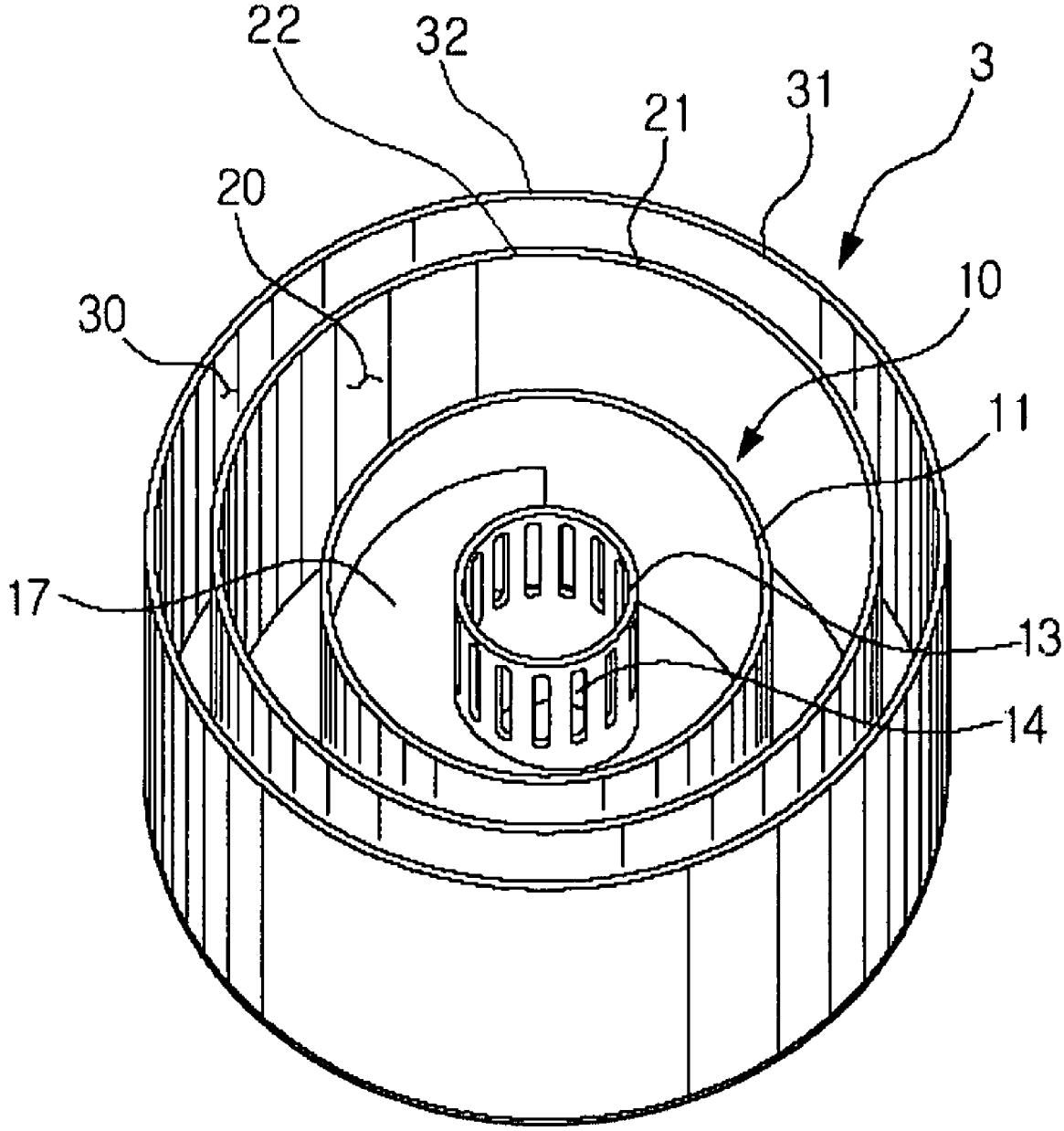
FIG. 2 is a perspective view illustrating a first cyclone unit of the cyclone separating apparatus of FIG. 1.

Referring to FIG. 2, the first contaminants chamber 20 may collect contaminants discharged from the first cyclone 10. The first contaminants chamber 20 may be disposed to enclose the first cyclone 10. It may be formed in a substantially hollow cylindrical shape. The first contaminants chamber 20 may be formed between the inner wall 11 and a middle wall 21, and the middle wall 21 may have a height higher than that of the inner wall 11.

The second contaminants chamber 30 may collect fine contaminants discharged from a plurality of second cyclones 50. The second contaminant chamber 30 may be disposed around the first contaminants chamber 20. It may be formed in a substantially hollow cylindrical shape. The second contaminants chamber 30 may be formed between the middle wall 21 and an outer wall 31, and the outer wall 31 may have substantially the same height as the middle wall 21.

As shown in FIG. 1, the second cyclone unit 5 may include the plurality of second cyclones 50, a discharging air gathering member 70, and a housing 60. The plurality of second cyclones 50 may be disposed downstream of the first cyclone 10. The plurality of second cyclones 50 separate fine contaminants from air that has been discharged from the first cyclone 10. A center axis 50*c* of each of the second cyclones 50 may be substantially perpendicular to a center axis 10*c* of the first cyclone 10. Thus, each of the plurality of second cyclones 50 may be disposed in a lying posture above the first cyclone 10 because the each of the plurality of second cyclones 50 is substantially perpendicular to the first cyclone 10.

Each of the second cyclones 50 may include a body part 51, a second air entrance 53, a second air exit 55, and a second contaminants outlet 57. The body part 51 may be formed as a substantially hollow cylindrical shape. The body part 51 may be disposed so that the center axis of the body part 51 is substantially perpendicular to the center axis 10*c* of the first cyclone 10. In the embodiment depicted, the center axis of the body part 51 is the same as the center axis 50*c* of the second cyclone 50. However, the center axis of the body part 51 need not be the same as the center axis 50*c* of the second cyclone 50. The body part 51 may have a diameter smaller than that of the first cyclone 10 so that the second cyclone 50 can separate fine contaminants from air. Also, a height of the second cyclone unit 5 may be reduced by disposing the body part 51 of each of the second cyclones 50 substantially perpendicular to the center axis 10*c* instead of substantially parallel with the center axis 10*c*.

Figure 3:
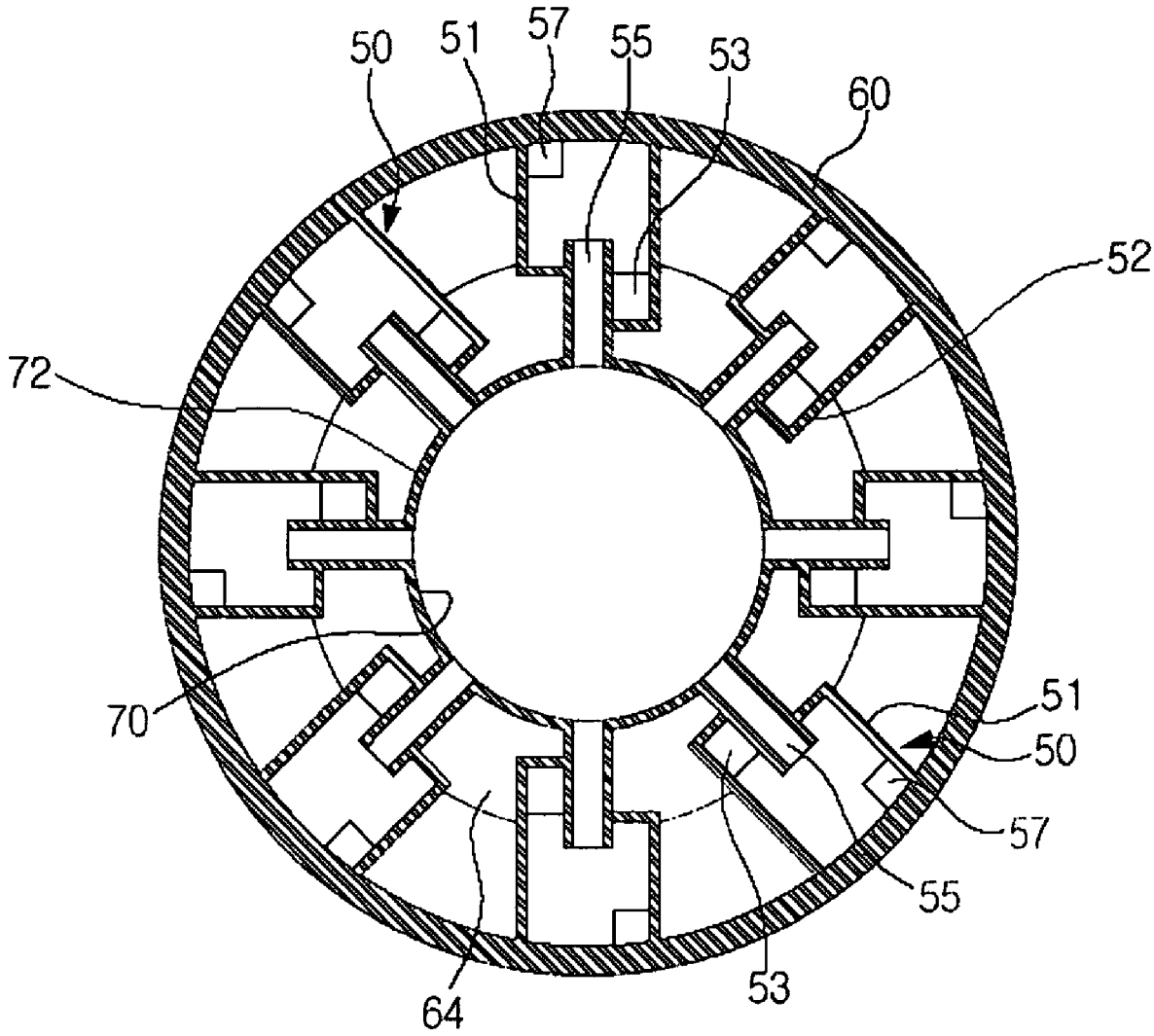
FIG. 3 is a sectional plan view illustrating the cyclone separating apparatus of FIG. 1 taken along a line II-II in FIG. 1.

Referring to FIG. 3, the second air entrance 53 and the second air exit 55 may be formed at one portion of the body part 51. The second air entrance 53 may be formed in a tangential direction to an outer circumferential surface 52 of the body part 51. The second air exit 55 may be formed as a substantially circular pipe. The second air exit 55 may be disposed coaxially with the body part 51 at approximately the center of the one portion of the body part 51. The second contaminants outlet 57 may be disposed at an opposite portion of the body part 51. The second air exit 55 may be connected with the discharging air gathering member 70, and the second contaminants outlet 57 may be in fluid communication with the second contaminants chamber 30.

As shown in FIG. 1, air discharged from the first cyclone 10 may enter the body part 51 through the second air entrance 53. Air entering the body part 51 whirls inside the body part 51 around the center axis of the body part 51. When air is whirling inside the body part 51, fine contaminants are separated from the air. Contaminants separated from air whirling in the body part 51 fall into the second contaminants chamber 30 through the second contaminants outlet 57, as shown by arrow L. The air may then be discharged through the second air exit 55 to the discharging air gathering member 70.

The discharging air gathering member 70 may be disposed at an approximate center of the plurality of second cyclones 50. The discharging air gathering member 70 may be formed in a substantially hollow cylindrical shape. The discharging air gathering member 70 may have a closed bottom and an open top. The open top may be connected with a vacuum generator (not illustrated) via a piping member (not illustrated).

The plurality of second cyclones 50 may be connected with an outer circumferential surface 72 of the discharging air gathering member 70. Thus, the second air exits 55 of the plurality of second cyclones 50 may be radially connected with the discharging air gathering member 70. The plurality of second cyclones 50 may be connected at equal angular intervals to the discharging air gathering member 70.

In the embodiment shown, eight second cyclones 50 are connected with the discharging air gathering member 70 at an equal angular interval. The arrangement of the eight second cyclones 50, as described above, is only exemplary and not intended to be limiting. The number of second cyclones 50 may be greater than or less than the eight second cyclones 50 depicted. The discharging air gathering member 70 may cause air discharged from each of the plurality of second cyclones 50 to be gathered and discharged through an upper side of the second cyclone unit 5.

The discharging air gathering member 70 may be disposed at approximately the center of the housing 60. The discharging air gathering member 70 may have its top end 74 opened to the upper side of the housing 60. The housing 60 may be formed in a substantially hollow cylindrical shape to envelop the plurality of second cyclones 50 with closed opposite ends. An inner space 64 of the housing 60 may guide air discharged from the first cyclone 10 to the second air entrance 53 of each of the plurality of second cyclones 50. A connection part 63 may be disposed at an approximate center of a bottom surface 61 of the housing 60. The connection part 63 may have a substantially funnel shape. The connection part 63 may have a bottom end 63*b* adapted to be coupled to the first air discharging pipe 13.

A backflow preventing member 67 may extend downwardly from the bottom surface 61 of the housing 60. The backflow preventing member 67 may be disposed near the periphery of a top end 63*a* of the connection part 63. The backflow preventing member 67 may be formed as a substantially hollow cylindrical shape. Also, the backflow preventing member 67 may have a diameter larger than that of the inner wall 11.

A gap 19 may be defined between a bottom end of the backflow preventing member 67 and the top end of the inner wall 11. Contaminants separated in the first cyclone 10 may be discharged into the first contaminants chamber 20 through the gap 19 between the backflow preventing member 67 and the inner wall 11.

Additionally, a first inserting groove 68 and a second inserting groove 69 may couple with at least one of the middle wall 21 and outer wall 31. Either the first inserting groove 68 or the second inserting groove 69 may be formed at the bottom surface 61 of the housing 60. Either the top end 22 (shown in FIGS. 2 and 4) of the middle wall 21 or the top end 32 (shown in FIGS. 2 and 4) of the outer wall 31 may be adapted to be inserted into the first inserting groove 68 or second inserting groove 69. Thus, the first inserting groove 68 or the second inserting groove 69 may be disposed to correspond to the middle wall 21 or outer wall 31. Therefore, when the second cyclone unit 5 is mounted on the upper side of the first cyclone unit 3, the first contaminants chamber 20 may be sealed from the second contaminants chamber 30, and the second contaminants chamber 30 may be sealed from the outside.

Hereinafter, an operation of the cyclone separating apparatus 100 for a vacuum cleaner according to a first embodiment of the present invention with the above-described structure will be explained in detail with reference to FIGS. 1 and 2.

When turning on the vacuum cleaner, the vacuum generator (not illustrated) may generate a suction force. Contaminants and air may be drawn-in through the suction nozzle (not illustrated) by the suction force. The contaminants and air may enter the first air entrance 16 of the first cyclone 10 of the cyclone separating apparatus 100, as shown by arrow A. After entering through the first air entrance 16, the contaminants and air may rise up along the sloping surface 17 to form an upwardly whirling air current, as shown by arrow B. The upwardly whirling air causes a centrifugal force that separates relatively large contaminants from the air. The separated contaminants may rise up along the inner wall 11 of the first cyclone 10. The rising contaminants may then be discharged through the gap 19 between the top end of the inner wall 11 and the bottom end of the backflow preventing member 67, as shown by arrow K. The contaminants may be collected in the first contaminants chamber 20.

After having relatively large contaminants removed in the first cyclone 10, air may be discharged through the plurality of slots 14 to the first air discharging pipe 13. Air entering the first air discharging pipe 13 may enter the inner space 64 of the housing 60 through the connection part 63, as shown by arrow C. Air in the inner space 64 may enter the second air entrance 53 of each of the plurality of second cyclones 50, as shown by arrow D. After entering through the second air entrance 53, air may whirl inside the body part 51 around the center axis of the body part 51, as shown by arrow E. The air may then be discharged through the second air exit 55 formed near the center of the body part 51, as shown by arrow F. While air is whirling inside the body part 51, fine contaminants are separated from the air. The separated fine contaminants may then be discharged through the second contaminants outlet 57 formed at the opposite portion of the body part 51, as shown by arrow L. The fine contaminants may then be collected in the second contaminants chamber 30.

Air discharged through the second air exit 55 from each of the second cyclones 50 may be gathered by the discharging air gathering member 70 and then discharged through the upper side of the housing 60, as shown by arrow G. Air discharged from the discharging air gathering member 70 may pass through the vacuum generator before being discharged outside the vacuum cleaner.

Figure 4:
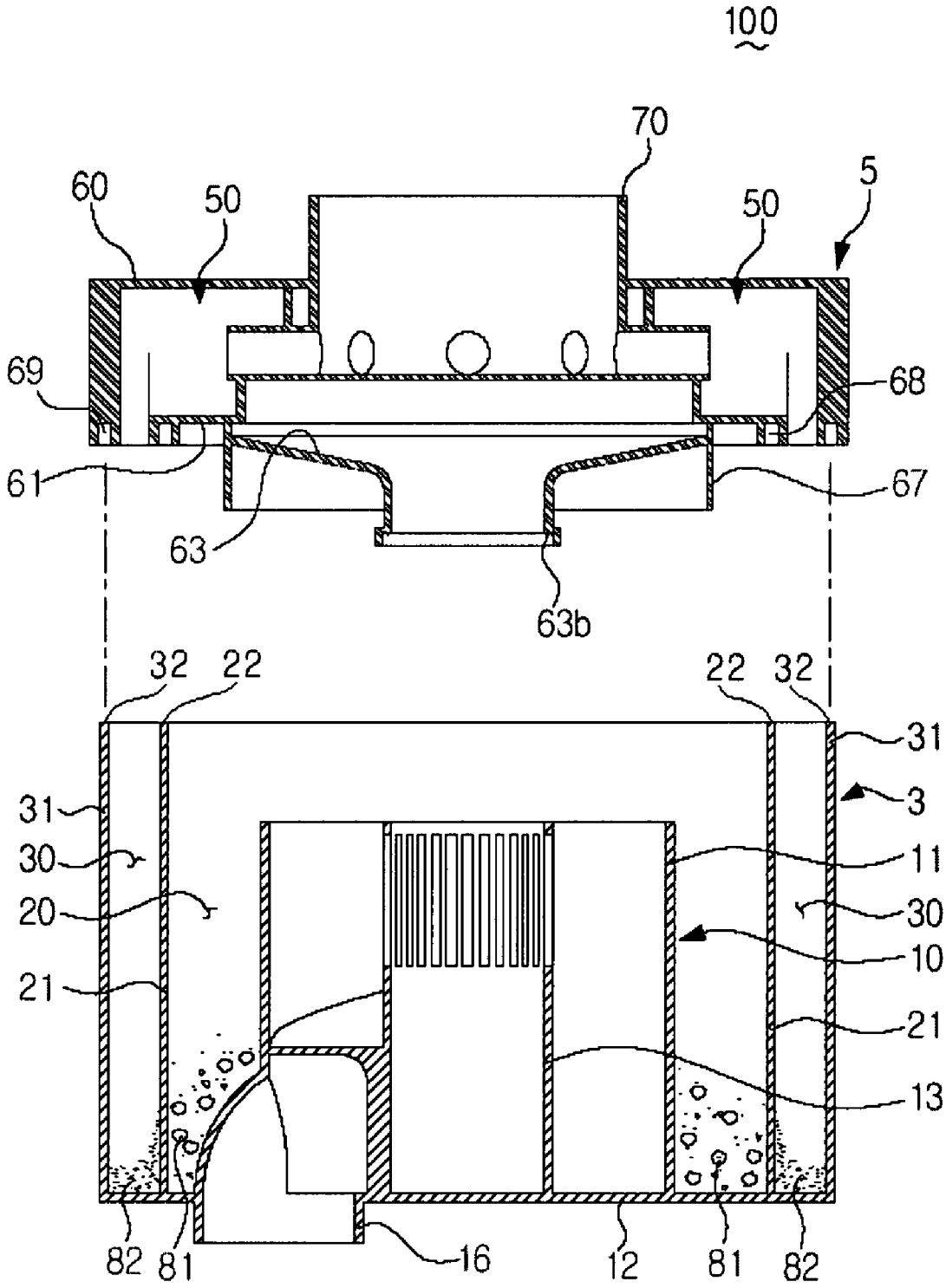
FIG. 4 is an exploded sectional view of the separated cyclone separating apparatus illustrated in FIG. 1.

Referring to FIG. 4, when at least one of the first and second contaminants chambers 20 and 30 of the first cyclone unit 3 is full, either the first or second contaminants chambers 20 and 30 can be emptied by separating the first cyclone unit 3 from the second cyclone unit 5. Then, the first cyclone unit 3 is turned upside down so that the collected contaminants 81 and 82 can be emptied.

Figure 5:
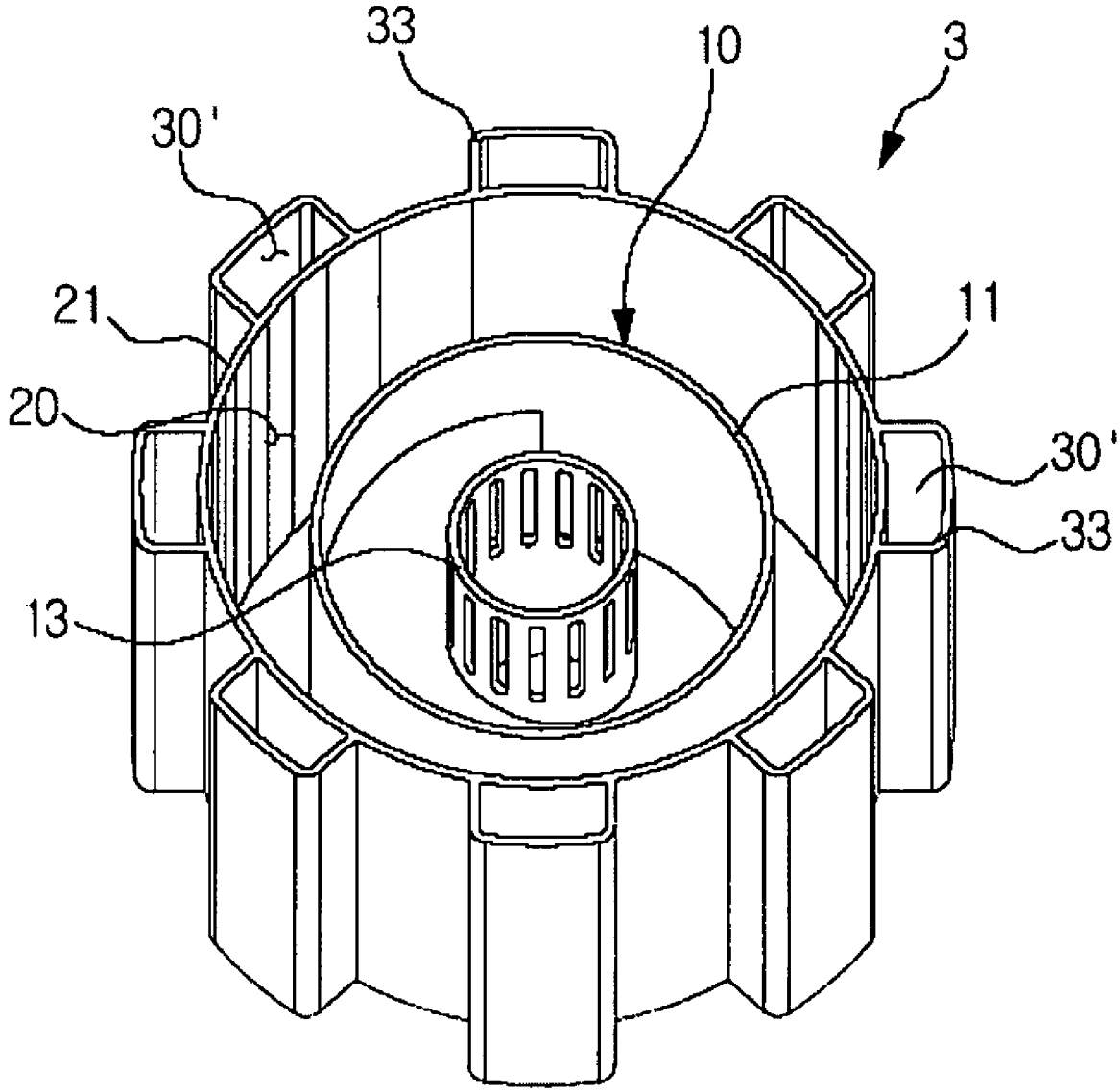
FIG. 5 is a perspective view illustrating another embodiment of the first cyclone unit of the cyclone separating apparatus of FIG. 1.

Referring to FIG. 5, an alternate second contaminants chamber 30' is shown. The second contaminants chamber 30' may be formed as a plurality of contaminants collecting boxes 33 corresponding to the number of the plurality of second cyclones 50. Each of the contaminants collecting boxes 33 may have a substantially rectangular parallelepiped shape. Each collecting box 33 may be disposed near the second contaminants outlet 57 of each of the plurality of second cyclones 50. Some parts of the middle wall 21 may be exposed between the plurality of contaminants collecting boxes 33. The middle wall 21 may be made of a transparent or semitransparent material. Therefore, a user can check the quantity of contaminants collected in the first contaminants chamber 20 through the parts of the middle wall 21 exposed between the plurality of contaminants collecting boxes 33. The plurality of contaminants collecting boxes 33 may also be made of a transparent or semitransparent material so that a user can check the quantity of contaminants collected in each of the plurality of contaminants collecting boxes 33.

Figure 6:
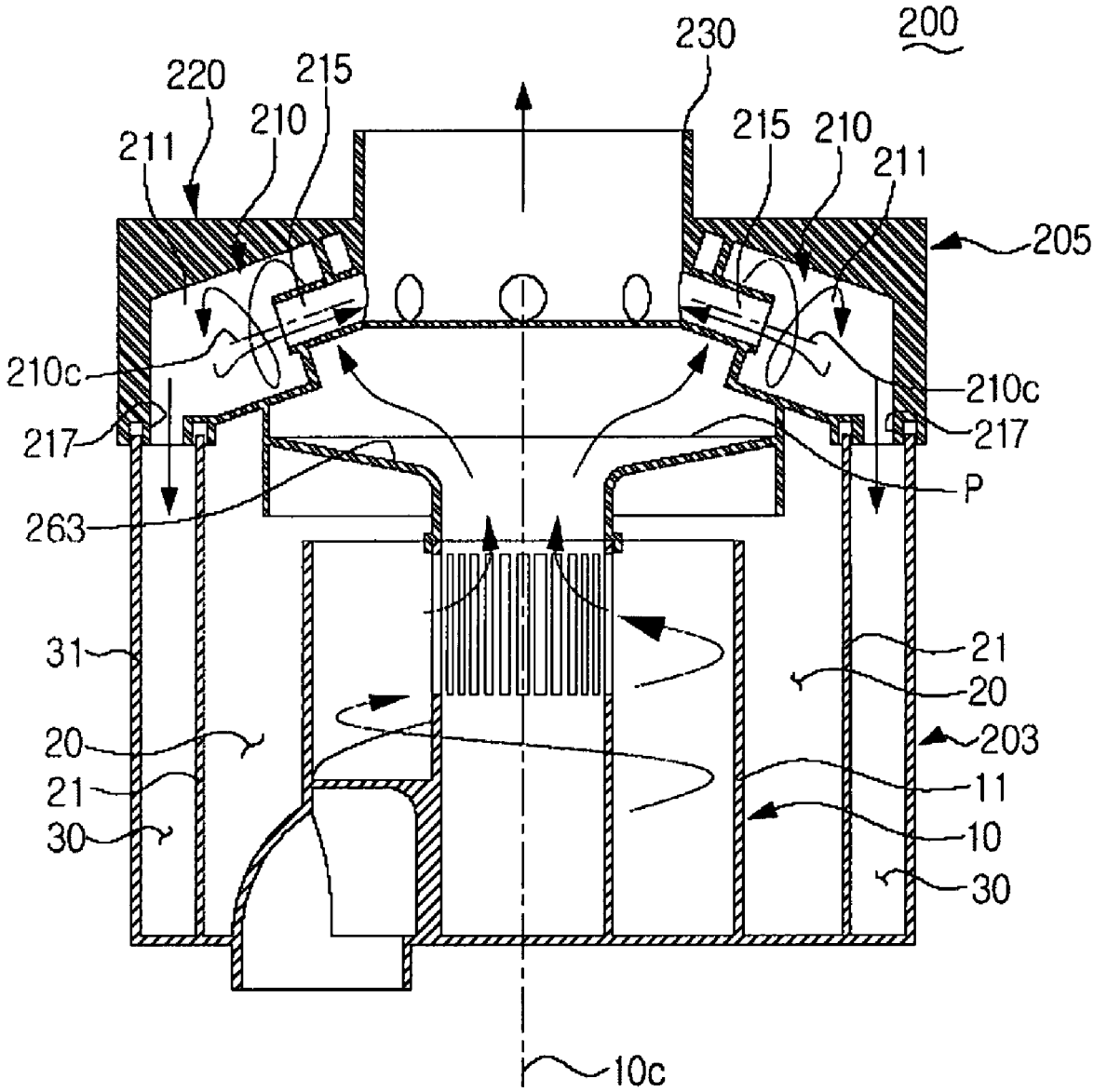
FIG. 6 is a sectional elevational view illustrating a cyclone separating apparatus for a vacuum cleaner according to a second embodiment of the present invention.

Referring to FIG. 6, a cyclone separating apparatus 200 for a vacuum cleaner according to a second embodiment of the present invention is shown. The cyclone separating apparatus 200 may include a first cyclone unit 203 and a second cyclone unit 205.

The first cyclone unit 203 may include a first cyclone 10, a first contaminants chamber 20, and a second contaminants chamber 30. The first cyclone unit 203 is substantially the same as the first cyclone unit 3 of the cyclone separating apparatus 100 for a vacuum cleaner according to the first embodiment of the present invention. Therefore, a detailed description thereof will be omitted.

The second cyclone unit 205 may include a plurality of second cyclones 210, a discharging air gathering member 230, and a housing 220.

The plurality of second cyclones 210 may be disposed downstream of the first cyclone 10. The plurality of second cyclones 210 may separate fine contaminants from air that has been discharged from the first cyclone 10. Each of the plurality of second cyclones 210 may be disposed above the first cyclone 10. Each of the plurality of second cyclones 210 may have a center axis 210*c* inclined or sloped upwardly with respect to an imaginary top plane P substantially defined by the top of the first cyclone 10. The second cyclone 210 may include a body part 211, a second air entrance (not illustrated), a second air exit 215, and a second contaminants outlet 217.

The body part 211 may be formed as a substantially hollow cylindrical shape. The body part 211 may be disposed so that the center axis 210*c* of the body part 211 is upwardly inclined with respect to the imaginary plane P. The second air entrance (not illustrated), the second air exit 215, and the second contaminants outlet 217 are similar to those of the second cyclone 50 of the cyclone separating apparatus 100 according to the first embodiment of the present invention; except that the second air entrance (not illustrated), the second air exit 215, and the second contaminants outlet 217 are adapted to the inclined body part 211. Therefore, detailed descriptions thereof will be omitted.

Furthermore, the housing 220 and the discharging air gathering member 230 are similar to the housing 60 and the discharging air gathering member 70 of the cyclone separating apparatus 100 according to the first embodiment of the present invention; therefore, detailed descriptions thereof will be omitted.

Operation of the cyclone separating apparatus 200 for a vacuum cleaner according to the second embodiment of the present invention with the above-described structure is similar to that of the cyclone separating apparatus 100 for a vacuum cleaner according to the first embodiment of the present invention; therefore, detailed description thereof will be omitted.

Figure 7:
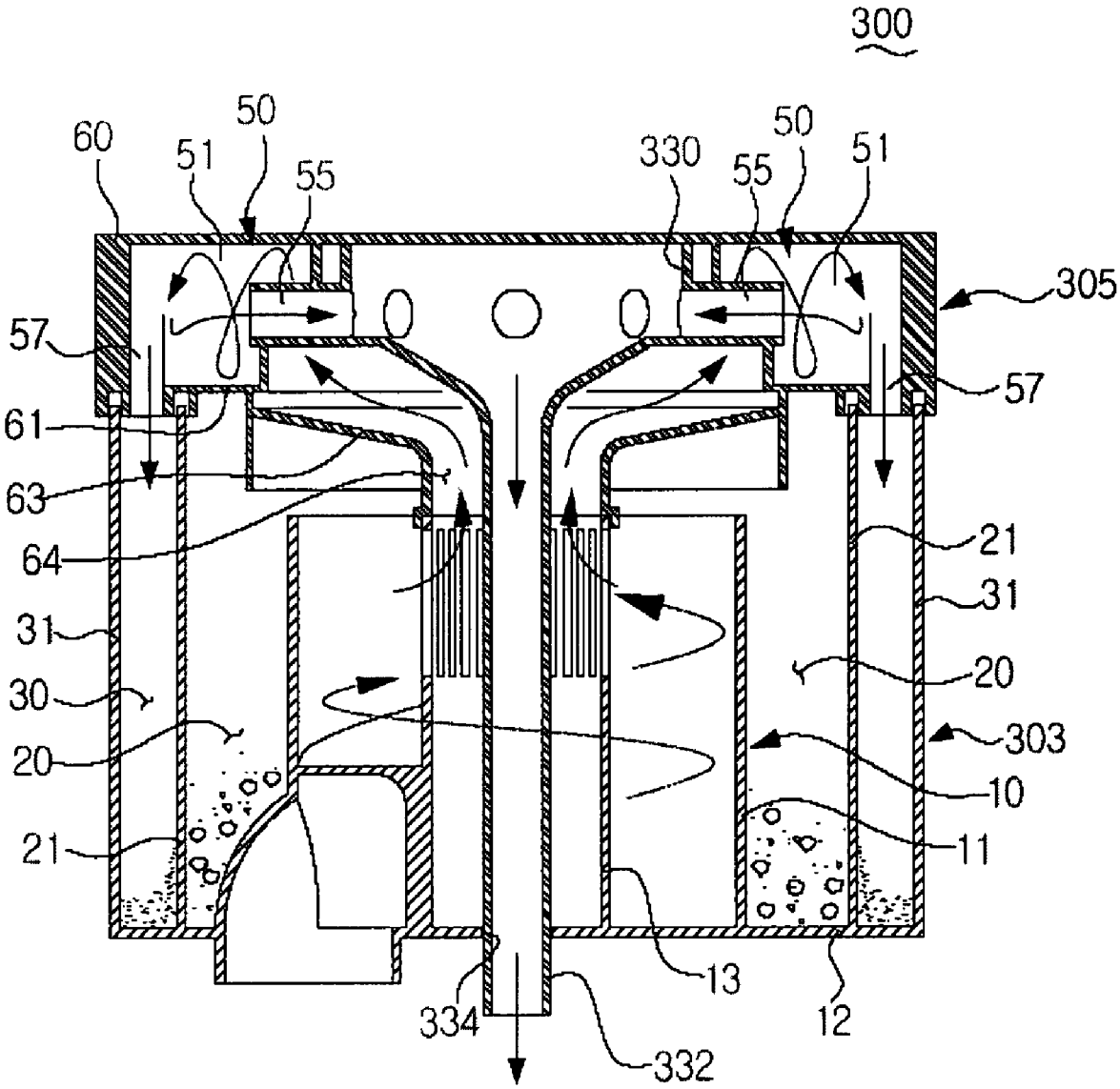
FIG. 7 is a sectional elevational view illustrating a cyclone separating apparatus for a vacuum cleaner according to a third embodiment of the present invention.

Referring to FIG. 7, a cyclone separating apparatus 300 for a vacuum cleaner according to a third embodiment of the present invention is shown. The cyclone separating apparatus 300 is substantially the same as the cyclone separating apparatus 100 for a vacuum cleaner according to the first embodiment of the present invention, except that air is discharged through a bottom plate 12 of the first cyclone unit 303. Hereinafter, parts of the cyclone separating apparatus 300 according to the third embodiment different from the cyclone separating apparatus 100 according to the first embodiment will be described.

A discharging air gathering member 330 of a second cyclone unit 305 may be formed in a substantially cylindrical shape. The discharging air gathering member 330 may have a closed top and a bottom connected with a second air discharging pipe 332. The second air discharging pipe 332 may have a diameter smaller than that of a first air discharging pipe 13 and may be disposed inside the first air discharging pipe 13. Also, a through hole 334 into which the second air discharging pipe 332 may be inserted may be formed in the bottom plate 12 of the first cyclone unit 303. The through hole 334 may be disposed substantially at the center of a bottom plate 12. Therefore, when the second cyclone unit 305 is mounted on an upper side of the first cyclone unit 303, a bottom end of the second air discharging pipe 332 may project from the bottom plate 12 of the first cyclone unit 303.

In the cyclone separating apparatus 300 according to the third embodiment of the present invention, air discharged from a plurality of second cyclones 50 may be gathered by the discharging air gathering member 330. The air may then be discharged below the first cyclone unit 303 through the second air discharging pipe 332.

The second air discharging pipe 332 may be formed integrally with the discharging air gathering member 330, as described above. Alternatively, the second air discharging pipe 332 may be formed integrally with the bottom plate 12 inside the first air discharging pipe 13. The second air discharging pipe 332 may be further provided with a top end (not illustrated) detachably connected with a bottom end (not illustrated) of the discharging air gathering member 330 similar to the first air discharging pipe 13. The second air discharging pipe 332 may be formed so that when the second cyclone unit 205 is mounted on the first cyclone unit 303, the second air discharging pipe 332 can be connected to the discharging air gathering member 330.

With a cyclone separating apparatus for a vacuum cleaner according to an embodiment of the present invention, because a first cyclone is provided with an air entrance disposed at a lower portion thereof and an air exit is disposed at an upper portion thereof, air may enter a lower portion of a first cyclone and then may be discharged through an upper portion thereof so that contaminants can be separated effectively.

Also, with a cyclone separating apparatus for a vacuum cleaner according to an embodiment of the present invention, the contaminants separated from air in the first cyclone may be collected in a space separately partitioned from where the air is whirling so that the collected contaminants do not affect the whirling air.

Additionally, a cyclone separating apparatus for a vacuum cleaner according to an embodiment of the present invention may have a first cyclone unit that can be separated from a second cyclone unit. Thus, it is easy for a user to empty contaminants collected in a first contaminant chamber and a second contaminants chamber.

Furthermore, because a plurality of second cyclones may be arranged substantially perpendicular to a first cyclone unit or slightly inclined with respect to a top surface of the first cyclone, a cyclone separating apparatus for a vacuum cleaner according to an embodiment of the present invention may have a height lower than a conventional cyclone separating apparatus which has a plurality of second cyclones substantially parallel to the first cyclone. Therefore, a cyclone separating apparatus for a vacuum cleaner according to an embodiment of the present invention can provide a more compact size than the conventional cyclone separating apparatus.

Also, a cyclone separating apparatus for a vacuum cleaner according to an embodiment of the present invention may be provided with a plurality of second contaminants chambers disposed at a predetermined angular interval around a first contaminants chamber. Thus, a user can see the quantity of contaminants collected in the first contaminants chamber without separating a second cyclone unit.

While the embodiments of the present invention have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the invention.

What is claimed is:

1. A cyclone separating apparatus for a vacuum cleaner comprising:

a first cyclone with an air entrance disposed on a lower portion of the first cyclone and an air exit disposed at an upper portion of the first cyclone;

a first contaminants chamber substantially enclosing the first cyclone to collect contaminants discharged from the first cyclone;

a plurality of second cyclones located above the first cyclone, the plurality of second cyclones being substantially perpendicular to a center axis of the first cyclone; and a second contaminants chamber disposed outside the first contaminants chamber to collect contaminants discharged from the plurality of second cyclones.

2. The cyclone separating apparatus of claim 1, wherein each of the second cyclones comprises:

a body part formed in a substantially hollow cylindrical shape with a first portion and an opposite second portion opposite the first portion, the body part disposed so that a center axis of the body part is substantially perpendicular to the center axis of the first cyclone;

a second air entrance disposed in a tangential direction to the first portion of the body part;

a second air exit disposed coaxially with the body part at the first portion of the body part; and a second contaminants outlet disposed at the opposite second portion of the body part.

3. The cyclone separating apparatus of claim 1, wherein air discharged from the plurality of second cyclones is discharged through an upper side of the cyclone separating apparatus.

4. The cyclone separating apparatus of claim 1, wherein air discharged from the plurality of second cyclones is discharged through a lower side of the cyclone separating apparatus.

5. The cyclone separating apparatus of claim 1, wherein the second contaminants chamber further comprises a plurality of contaminants collecting boxes corresponding to the plurality of second cyclones.

6. A cyclone separating apparatus for a vacuum cleaner comprising:

a first cyclone unit including, a first cyclone with an air entrance disposed on a lower portion of the first cyclone and an air exit disposed at an upper portion of the first cyclone, a first contaminants chamber substantially enclosing the first cyclone to collect contaminants discharged from the first cyclone, and a second contaminants chamber disposed outside the first contaminants chamber; and a second cyclone unit including, a plurality of second cyclones disposed above the first cyclone unit and substantially perpendicular to a center axis of the first cyclone, a discharging air gathering member in fluid communication with the plurality of second cyclones, and a housing substantially enclosing the plurality of second cyclones.

7. The cyclone separating apparatus of claim 6, wherein each of the second cyclones further comprises:

a body part formed in a substantially hollow cylindrical shape with a first portion and an opposite second portion opposite the first portion, the body part disposed so that a center axis of the body part is substantially perpendicular to the center axis of the first cyclone;

a second air entrance disposed in a tangential direction to the first portion of the body part;

a second air exit disposed coaxially with the body part at the first portion of the body part; and a second contaminants outlet disposed at the opposite second portion of the body part.

8. The cyclone separating apparatus of claim 7, wherein the second air exit of each of the second cyclones is radially connected with the discharging air gathering member.

9. The cyclone separating apparatus of claim 8, wherein the discharging air gathering member is formed so that air is discharged through an upper side of the second cyclone unit.

10. The cyclone separating apparatus of claim 8, wherein the discharging air gathering member is formed so that air is discharged through a lower side of the first cyclone unit.

11. The cyclone separating apparatus of claim 10, further comprising a second air discharging pipe disposed at a center of the first cyclone.

12. The cyclone separating apparatus of claim 6, further comprising:

a first air discharging pipe disposed inside the first cyclone; and a connection part disposed at a bottom surface of the housing, the connection part coupling with a top end of the first air discharging pipe and adapted to guide air discharged from the first air discharging pipe to each of the plurality of second cyclones.

13. The cyclone separating apparatus of claim 12, further comprising a second air discharging pipe disposed inside the first air discharging pipe and extending downwardly from a bottom end of the discharging air gathering member.

14. The cyclone separating apparatus of claim 6, wherein the second contaminants chamber comprises a plurality of contaminants collecting boxes corresponding to the plurality of second cyclones.

15. The cyclone separating apparatus of claim 14, wherein the plurality of contaminants collecting boxes is made of a transparent material or a semitransparent material.

* * * * *